US010098424B1

(12) United States Patent
Husted et al.

(10) Patent No.: US 10,098,424 B1
(45) Date of Patent: Oct. 16, 2018

(54) IMPACT ABSORBING FLEXIBLE WALKING AID

(71) Applicants: Royce Husted, Forest, VA (US); Joel Husted, Forest, VA (US)

(72) Inventors: Royce Husted, Forest, VA (US); Joel Husted, Forest, VA (US)

( * ) Notice: Subject to any disclaimer, the term of this patent is extended or adjusted under 35 U.S.C. 154(b) by 0 days.

(21) Appl. No.: 15/892,022

(22) Filed: Feb. 8, 2018

(51) Int. Cl.
*A45B 9/00* (2006.01)
*A61H 3/00* (2006.01)
*A61H 3/02* (2006.01)

(52) U.S. Cl.
CPC ..... *A45B 9/00* (2013.01); *A61H 3/00* (2013.01); *A61H 3/0277* (2013.01); *A45B 2009/005* (2013.01); *A61H 2003/001* (2013.01)

(58) Field of Classification Search
CPC ..... A45B 2009/007; A45B 9/00; A45B 2009/005; A45B 2200/055; A61H 3/0277; A61H 3/00; A61H 2003/0283; A61H 2003/0211; A61H 2003/001; A61H 2201/0165
USPC ..... 135/65, 69–70, 72, 82, 84; 280/819, 821
See application file for complete search history.

(56) References Cited

U.S. PATENT DOCUMENTS 5,509,936 A * 4/1996 Rappoport ..... A61F 2/60 623/27
5,984,359 A * 11/1999 Faiks ..... A63C 11/22 135/86
7,735,501 B2 * 6/2010 Townsend ..... A61F 2/60 135/66
7,954,502 B2 * 6/2011 Townsend ..... A61H 3/02 135/66
8,858,401 B2 * 10/2014 Kaupe ..... A45B 1/02 135/65
9,089,194 B2 * 7/2015 Tessier ..... A45B 1/00
9,586,129 B2 * 3/2017 Henrie ..... A63C 11/227
9,763,502 B2 * 9/2017 Rudin ..... A45B 9/04
2004/0107981 A1 * 6/2004 Smith ..... A45B 9/00 135/65
2004/0250845 A1 * 12/2004 Rudin ..... A45B 7/005 135/77
2009/0159106 A1 * 6/2009 Schulz ..... A45B 9/02 135/75
2010/0206348 A1 * 8/2010 Markou ..... A61H 3/02 135/71

(Continued)

FOREIGN PATENT DOCUMENTS

WO WO-2008010346 A1 * 1/2008 ..... A61H 3/02

*Primary Examiner* — Winnie Yip
(74) *Attorney, Agent, or Firm* — Patent Law of Virginia, PLLC; Brian J. Teague

(57) ABSTRACT

A cane comprises a handle, a foot, and a flexible flat spring member connecting the handle and the foot. The flexible flat spring member may be positioned to flex forwardly in a direction of travel of a user. The handle end may project rearward from a vertical center of the flat spring member. The cane may further comprise a flexible tube shrouding the flat spring member. The cane may further comprise a rigid strut member aligned with the flat spring member for selectively locking the flat spring member into a rigid condition and a first notch positioned for selectively engaging a lower end of the rigid strut member, such that the flat spring member is locked into a rigid condition when the lower end of the rigid strut member is engaged with the first notch.

7 Claims, 2 Drawing Sheets

(56) References Cited

U.S. PATENT DOCUMENTS

2012/0024634 A1* 2/2012 Walker ..... B63H 16/04
185/37

* cited by examiner

IMPACT ABSORBING FLEXIBLE WALKING AID

FIELD OF THE INVENTION

The present invention relates to an improvement in manual walking aids including canes, walking sticks, crutches and the likes and more particularly walking canes.

BACKGROUND OF THE INVENTION

Physical therapists know that the use of walking aids can cause injury. Anyone familiar with walking canes knows they can injure the hand, wrist, arm, and shoulder as it cyclically impacts the ground.

BRIEF SUMMARY

This invention utilizes a flat spring to absorb the harsh loads delivered by conventional canes. The invention can also provide a lifting action for assistance in getting up from a chair or climbing up or down stairs. The invention provides a lively feel but a rigid cane may be desired under some conditions. In such conditions a lock strut makes the invention perform as a common cane. The same strut limits the stroke from flexing beyond its breaking point. The lock strut and the stroke limit strut are one in the same and an integral part of the cane's structure. Each of these features is described herein.

In one embodiment of the invention, a cane comprises a handle, a foot, and a flexible flat spring member connecting the handle and the foot. The flexible flat spring member may be positioned to flex forwardly in a direction of travel of a user. The handle end may project rearward from a vertical center of the flat spring member. The cane may further comprise a flexible tube shrouding the flat spring member. The cane may further comprise a rigid strut member aligned with the flat spring member for selectively locking the flat spring member into a rigid condition. The cane may further comprise a first notch positioned for selectively engaging a lower end of the rigid strut member, such that the flat spring member is locked into a rigid condition when the lower end of the rigid strut member is engaged with the first notch. The cane may further comprise a second notch positioned lower than the first notch and positioned for selectively engaging a lower end of the rigid strut member, such that the flat spring member is restricted from flexing beyond its breaking point when the lower end of the rigid strut member is engaged with the second notch. The flexible flat spring member and the rigid strut member may be molded in one piece from a plastic material.

In addition to canes, as described above, other aspects of the present invention are directed to corresponding walking sticks and crutches having the herein described flexible flat spring member.

BRIEF DESCRIPTION OF THE DRAWINGS

These and other objects and advantages of the invention will be apparent upon reading the following description in conjunction with the drawings in which.

DETAILED DESCRIPTION OF THE INVENTION

This invention provides a suspension system for supporting canes, walking sticks, crutches and the likes. For the purpose of clarity this disclosure describes the invention as applied to a walking cane.

Figure 1:
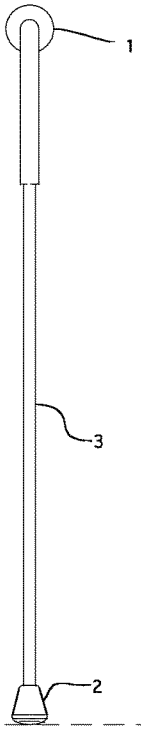
FIG. 1 is a front elevation of a flexible walking aid of embodiments of the invention.
Figure 2:
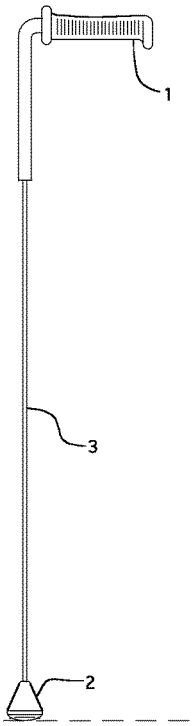
FIG. 2 is a side elevation of the flexible walking aid of FIG. 1.
Figure 3:
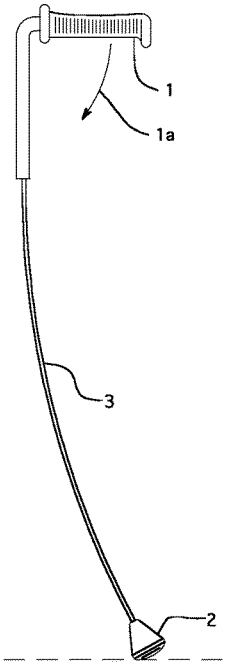
FIG. 3 is a side elevation of the flexible walking aid of FIG. 1 with a flat spring in a partially flexed condition.

FIGS. 1-3 depict the fundamental version of the flexible cane invention. A handle 1 comprises a right angle tubular frame with a contoured grip pressed there on. Relative to the direction of travel, the handle 1 extends rearward from the vertical center of a flat spring 3. With this design the handle 1 applies a torquing action 1*a* to initiate and sustain the bending action of the flat spring 3 as shown in FIG. 3. It should be noted that the broad surface of the flat spring 3 faces the direction of travel and flexes forwardly as depicted in FIG. 3. It is an inherent action of flat springs to flex on one plane and this is an important stabilizing feature in the use of this invention.

The flat spring 3 may be made from a pultruded glass fiber reinforced polymer as commonly used for hunting bows and automotive suspension systems. This material is lightweight, strong and exceedingly resilient. The cross sectional dimensions and the choice of material for the composition of the flat spring can change its flex rate significantly. The ideal spring resistance could be matched to user preference. A foot 2 is made of a suitable traction material and is firmly bonded on the lower end of the flat spring 3.

Figure 4:
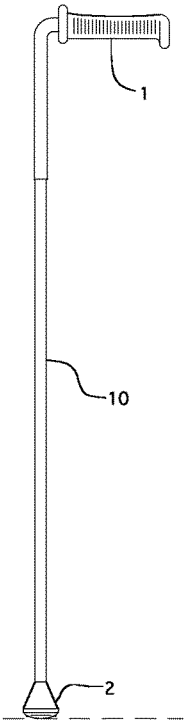
FIG. 4 is a side elevation of a flexible walking aid of alternative embodiments of the invention with the flat spring incased in a flexible tube to render a stronger and more conventional appearance.

FIG. 4 is the fundamental version of the flexible cane as described above but with the flat spring shrouded in a flexible tube 10. The tube is a flexible non-kinking material such as polyurethane. The tube 10 slips over the flat spring 3 and is held in place by the foot 2.

The flexible tube 10 does not alter the mechanics but it presents a stronger and more conventional appearance to the beholder.

FIGS. 5-8 depict the flexible cane invention made as a single piece molded plastic part. It should be noted that the same function could be achieved using alternative methods of fabrication however the rendered design provides a lightweight, and low cost product.

Figure 5:
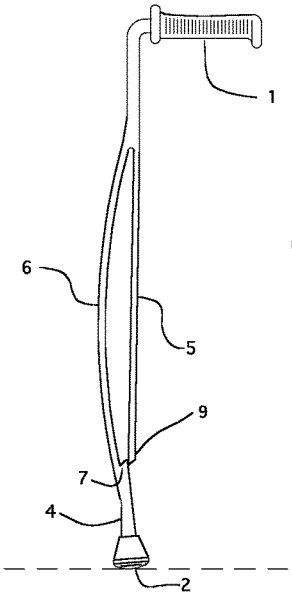
FIG. 5 is a side elevation of a flexible walking aid of alternative embodiments of the invention in an unloaded condition and with the tip of an integral strut portion in a passive position on the ankle section.
Figure 6:
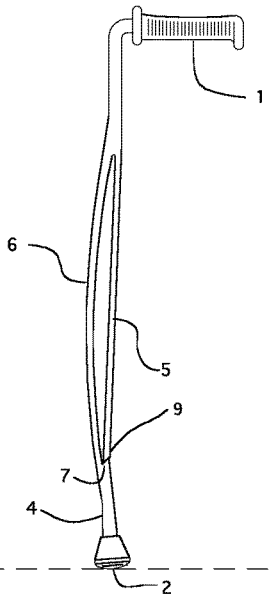
FIG. 6 is a side elevation of the flexible walking aid of FIG. 5 with the tip of an integral strut engaged with a locking notch in the ankle section.

Referring to FIG. 5 and FIG. 6, while the spring suspension system is beneficial for most conditions there may be circumstances where a conventional rigid cane would be preferred. A strut 5 is molded adjacent to the flat spring 6. The strut 5 has a larger and more rigid cross-section than the flat spring 6. When the user squeezes together at the longitudinal centers of strut 5 and flat spring 6, the tip 9 of strut 5 is pulled upward relative to a lock notch 7 in the surface of the ankle 4 and is therefore able to lock into lock notch 7. In the locked condition the flat spring 6 and the strut 5 form a ridged triangular structure and the flexible cane invention effectively becomes a rigid cane as depicted in FIG. 6. To disengage the lock the user pulls apart at the longitudinal centers of strut 5 and flat spring 6.

Figure 7:
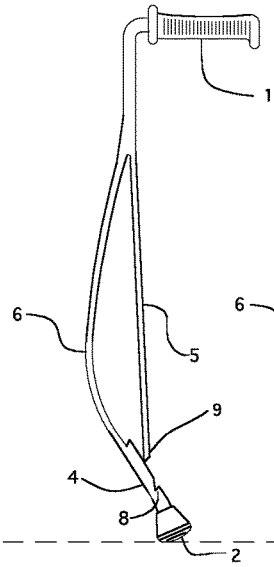
FIG. 7 is a side elevation of the flexible walking aid of FIG. 5 with the flat spring section partially flexed.
Figure 8:
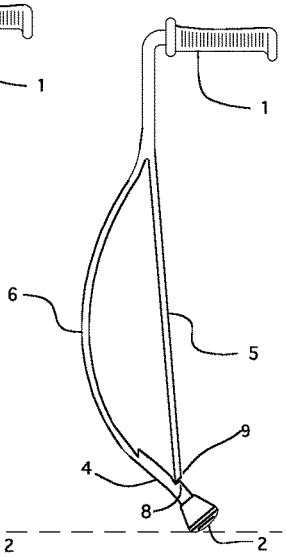
FIG. 8 is a side elevation of the flexible walking aid of FIG. 5 with the flat spring section fully flexed and with the tip of the integral strut section nested in a stroke limit notch in the ankle section.

Referring to FIG. 7 and FIG. 8, to stop the flat spring 6 from flexing beyond its breaking point the tip 9 of strut 5 passively slides down the surface of the ankle portion 4 to engage in a stop notch 8. In this condition the strut 5 stops the flat spring 6 from flexing beyond its breaking point.

Figure 9:
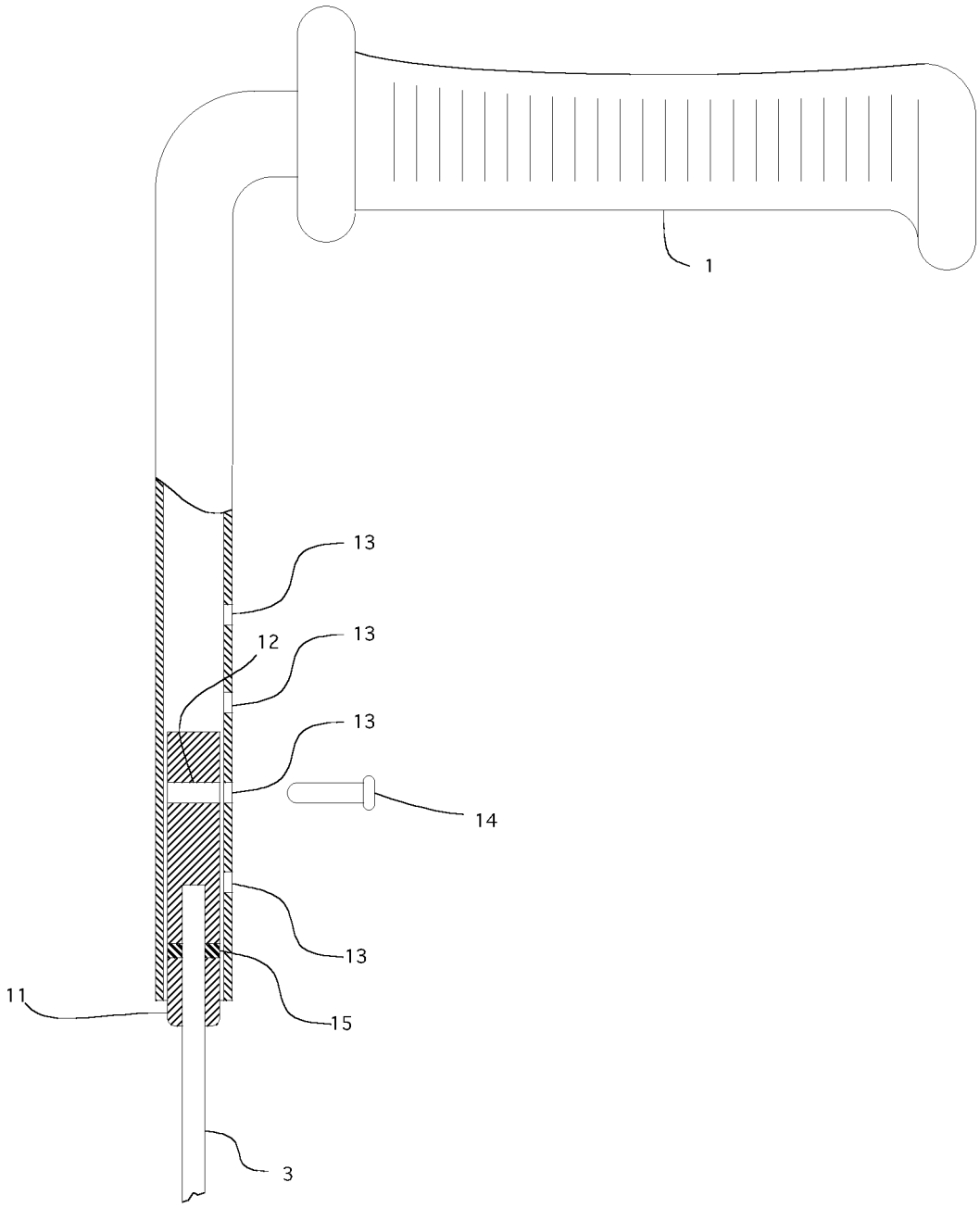
FIG. 9 is a side elevation for the basic design of the invention with a cross sectional view of a tubular handle exposing an adjustment feature with locking pin, the lower extremity of the device is not shown to provide a large scale view of the pertinent subject.

Referring to FIG. 9, a length adjustment system is important to satisfy the wide range of users body height and users comfort preferences. FIG. 9 shows the flat spring 3 retained in a bushing 11 by means of a pin 15. Bushing 11 slides within the tubular handle 1. A through hole 12 in the bushing 11 receives a lock pin 14 to retain a position in any one of a series of holes 13 in the tubular handle 1. The overall adjustable range accommodates the height and comfort requirements of most users.

What has been described is a novel impact absorbing flexible walking aid. It is recognized that numerous changes to the described embodiment of the invention will be apparent to those skilled in the art without departing from its true spirit and scope. The invention is to be limited only as defined in the claims.

What is claimed is:

1. A cane comprising:

a handle;

a foot;

a flexible flat spring member connecting the handle and the foot; and a rigid strut member having a fixed upper end and a lower end selectively transitionable between a disengaged condition in which the flat spring member is flexible and an engaged condition for selectively locking the flat spring member into a rigid condition.

2. The cane of claim 1, wherein the flexible flat spring member is positioned to flex forwardly in a direction of travel of a user.

3. The cane of claim 1, wherein a handle end projects rearward from a vertical center of the flat spring member.

4. The cane of claim 1, further comprising a flexible tube shrouding the flat spring member.

5. The cane of claim 1, further comprising a first notch positioned for selectively engaging the lower end of the rigid strut member, such that the flat spring member is locked into a rigid condition when the lower end of the rigid strut member is engaged with the first notch.

6. The cane of claim 5, further comprising a second notch positioned lower than the first notch and positioned for selectively engaging the lower end of the rigid strut member, such that the flat spring member is restricted from flexing beyond its breaking point when the lower end of the rigid strut member is engaged with the second notch.

7. The cane of claim 1, wherein the flexible flat spring member and the rigid strut member are molded in one piece from a plastic material.

* * * * *